US008973296B1

(12) United States Patent
Kocmich, IV

(10) Patent No.: US 8,973,296 B1
(45) Date of Patent: Mar. 10, 2015

(54) ACCESSORY RAIL ADAPTOR

(71) Applicant: Edward Kocmich, IV, Keithville, LA (US)

(72) Inventor: Edward Kocmich, IV, Keithville, LA (US)

( * ) Notice: Subject to any disclaimer, the term of this patent is extended or adjusted under 35 U.S.C. 154(b) by 0 days.

(21) Appl. No.: 14/461,699

(22) Filed: Aug. 18, 2014

(51) Int. Cl.
*F41C 27/00* (2006.01)

(52) U.S. Cl.
CPC ..... *F41C 27/00* (2013.01)
USPC ..... 42/90; 42/94

(58) Field of Classification Search
USPC ..... 42/90, 124, 127, 94, 96, 106, 71.01, 72, 42/85, 86
See application file for complete search history.

(56) References Cited

U.S. PATENT DOCUMENTS

| | | | | |
|---|---|---|---|---|
| 6,438,888 | B1 * | 8/2002 | Lin et al. | 42/114 |
| 6,449,893 | B2 * | 9/2002 | Spinner | 42/127 |
| 6,922,934 | B1 * | 8/2005 | Huan | 42/127 |
| 6,931,779 | B1 * | 8/2005 | Galuppo, Jr. | 42/127 |
| 7,543,405 | B1 * | 6/2009 | Ivey | 42/125 |
| 8,336,246 | B1 * | 12/2012 | Barber | 42/127 |
| 8,650,793 | B1 * | 2/2014 | Mendez | 42/90 |
| 8,898,949 | B1 * | 12/2014 | Greenwood | 42/90 |
| 2008/0157607 | A1 * | 7/2008 | Scheich et al. | 310/12 |

* cited by examiner

*Primary Examiner* — Jonathan C Weber
(74) *Attorney, Agent, or Firm* — R. Keith Harrison

(57) ABSTRACT

An accessory rail adaptor includes an adaptor body having a first attachment surface and a second attachment surface; an adaptor rail carried by the first attachment surface of the adaptor body; an adaptor roller carried by the adaptor body adjacent to the second attachment surface; and an adaptor flange carried by the adaptor body adjacent to the second attachment surface and in spaced-apart relationship to the adaptor roller, the adaptor flange selectively moveable relative to the adaptor roller.

20 Claims, 3 Drawing Sheets

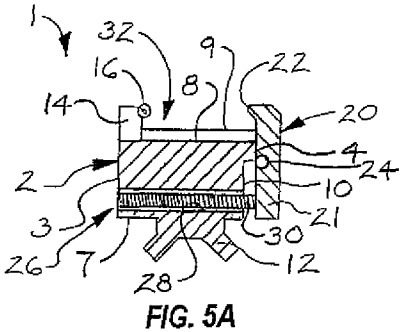
FIG. 5A
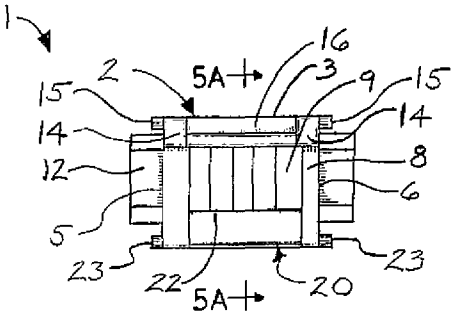
FIG. 5
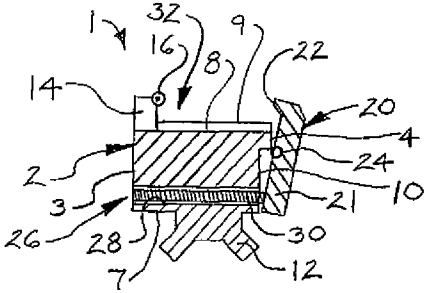
FIG. 5B
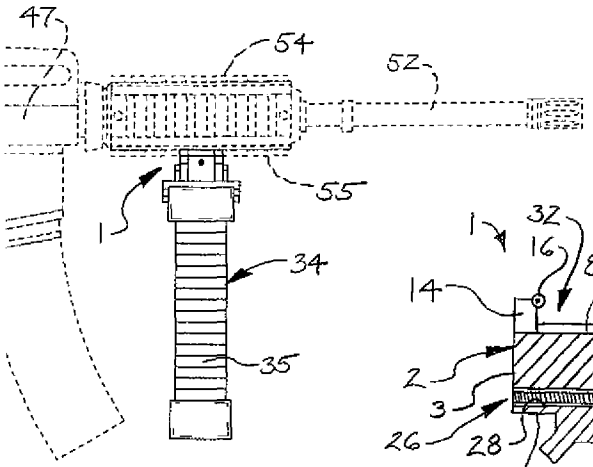
FIG. 6
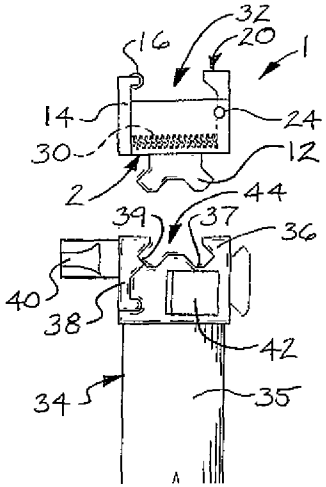

ACCESSORY RAIL ADAPTOR

FIELD

Illustrative embodiments of the disclosure generally relate to firearms. More particularly, illustrative embodiments of the disclosure relate to an accessory rail adaptor which facilitates expeditious attachment and removal of a firearm accessory to and from a firearm.

BACKGROUND

The background description provided herein is solely for the purpose of generally presenting the context of various illustrative embodiments of the disclosure. Aspects of the background description are neither expressly nor impliedly admitted as prior art against the claimed subject matter.

Semiautomatic and automatic firearms are typically fitted with accessory mount rails which facilitate attachment of an accessory such as a light, scope or firearm support device such as a bipod or tripod to the firearm. The firearm support device enables a user of the firearm to grip the firearm when hand-held or rest the firearm on the ground or other support surface during use. The firearm support device is typically attached to the firearm by first sliding an accessory mount rail on the firearm lengthwise into a companion width-adjustable rail slot in the accessory, after which the width of the rail slot may be adjusted to tightly engage and secure the accessory mount rail. However, this method of attachment may be laborious, cumbersome and time-consuming, particularly under circumstances in which the firearm accessory must be quickly attached to and detached from the firearm as in law enforcement and military applications.

Accordingly, an accessory rail adaptor which facilitates expeditious attachment and removal of a firearm accessory to and from a firearm may be desirable in some applications.

SUMMARY

Illustrative embodiments of the disclosure are generally directed to an accessory rail adaptor which facilitates expeditious attachment and removal of a firearm accessory to and from a firearm. An illustrative embodiment of the accessory rail adaptor includes an adaptor body having a first attachment surface and a second attachment surface; an adaptor rail carried by the first attachment surface of the adaptor body; an adaptor roller carried by the adaptor body adjacent to the second attachment surface; and an adaptor flange carried by the adaptor body adjacent to the second attachment surface and in spaced-apart relationship to the adaptor roller, the adaptor flange selectively moveable relative to the adaptor roller.

BRIEF DESCRIPTION OF THE DRAWINGS

Illustrative embodiments of the disclosure will now be described, by way of example, with reference to the accompanying drawings, in which:

FIG. 4A is an exploded front view illustrating typical attachment of an illustrative accessory rail adaptor to the firearm support device;

FIG. 5 is top view of the illustrative accessory rail adaptor;

FIG. 5A is a cross-sectional view, taken along section lines 5A-5A in FIG. 5, with the adaptor flange on the illustrative accessory rail adaptor deployed in a rail locking position;

FIG. 5B is a cross-sectional view, taken along section lines 5A-5A in FIG. 5, with the adaptor flange on the illustrative accessory rail adaptor deployed in a rail unlocking position;

FIG. 6 is a side view of a firearm with an illustrative accessory rail adaptor attaching a firearm support device to the firearm in typical application of the accessory rail adaptor, the firearm support device deployed in a grip configuration.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. As used herein, relative terms such as "upper", "lower", "side" and "end" are intended to be used in an illustrative and not a limiting sense. In some applications, for example, those elements which are identified as "lower" may be located in other spatial relationships relative to those elements which are identified as "lower" in the following detailed description.

Figure 7:
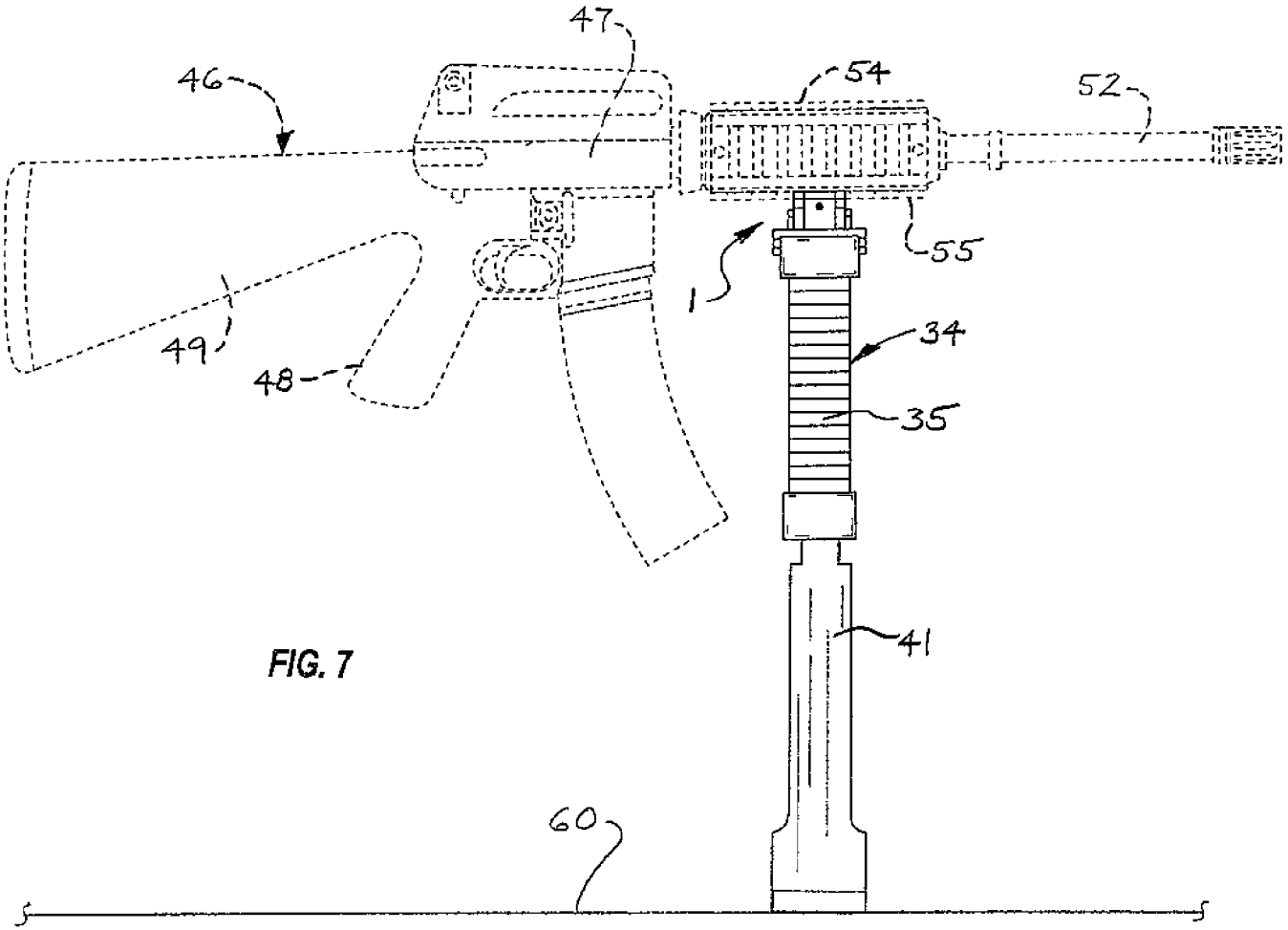
FIG. 7 is a side view of a firearm with an illustrative accessory rail adaptor attaching a firearm support device to the firearm in typical application of the accessory rail adaptor, the firearm support device deployed in a bipod support configuration.

Referring to the drawings, an illustrative embodiment of the accessory rail adaptor is generally indicated by reference numeral 1. As illustrated in FIGS. 6 and 7, in typical application, which will be hereinafter described, the accessory rail adaptor 1 may facilitate expeditious attachment of a firearm accessory such as a firearm support device 34, for example and without limitation, to a firearm 46 and detachment of the firearm accessory from the firearm 46. As particularly illustrated in FIGS. 5, 5A and 5B, the accessory rail adaptor 1 may include an adaptor body 2. The adaptor body 2 and other components of the accessory rail adaptor 1, which will be hereinafter described, may include metal such as aluminum or steel and/or a composite material such as carbon fiber composite or plastic, for example and without limitation. As illustrated in FIGS. 5A and 5B, the adaptor body 2 may include a first adaptor body side surface 3; a second adaptor body side surface 4 which is opposite the first adaptor body side surface 3; and a first adaptor body end 5 and a second adaptor body end 6 at opposite ends of the adaptor body 2. The adaptor body 2 may further include a first attachment surface 7 and a second attachment surface 8 which is opposite the first attachment surface 7. An adaptor rail 12 is provided on the first attachment surface 7 of the adaptor body 2. In some embodiments, multiple adaptor ridges 9 may extend from the second attachment surface 8 in generally parallel, spaced-apart relationship to each other for purposes which will be hereinafter described.

The adaptor rail 12 on the second attachment surface 7 of the adaptor body 2 may correspond in size and configuration to a standard or conventional accessory mount rail such as an upper accessory mount rail 54 and a lower accessory mount rail 55 (FIGS. 6 and 7) commonly used on conventional automatic and semiautomatic firearms 46. In some embodiments, the adaptor rail 12 may correspond in size and configuration to a standard or conventional Weaver rail mount or Picatinny mount (such as a mil-standard 1913 rail), for example and without limitation.

An adaptor roller 16 is provided on the adaptor body 2. The adaptor roller 16 is disposed adjacent to the second attachment surface 8 of the adaptor body 2. An adaptor flange 20 is provided on the adaptor body 2. The adaptor flange 20 is disposed adjacent to the second attachment surface 8 and in spaced-apart relationship to the adaptor roller 16. The adaptor flange 20 is selectively moveable toward and away from the adaptor roller 16 such as in a manner and for a purpose which will be hereinafter described.

The adaptor roller 16 may be mounted on the adaptor body 2 according to any suitable technique which is known by those skilled in the art. As particularly illustrated in FIG. 5, in some embodiments, a pair of spaced-apart roller mount arms 14 may extend from the adaptor body 2 at the first adaptor body side surface 3. The roller mount arms 14 may be secured to the adaptor body 2 via arm fasteners 15. The roller mount arms 14 may protrude beyond the second attachment surface 8 of the adaptor body 2. The adaptor roller 16 may be journaled for rotation between the roller mount arms 14 according to the knowledge of those skilled in the art.

The adaptor flange 20 may be mounted for selective movement toward and away from the adaptor roller 16 according to any suitable technique which is known by those skilled in the art. In some embodiments, the adaptor flange 20 may be pivotally attached to the second adaptor body side surface 4 of the adaptor body 2 via a flange mount shaft 24. The flange mount shaft 24 may be secured at each end via a pair of flange fasteners 23. Accordingly, the adaptor flange 20 may be selectively pivotal between a locking position illustrated in FIG. 5A, in which the adaptor flange 20 is oriented toward the adaptor roller 16, and a release position illustrated in FIG. 5B, in which the adaptor flange 20 is oriented away from the adaptor roller 16. As illustrated in FIG. 5B, a flange pivot space 10 may be provided in the second adaptor body side surface 4 of the adaptor body 2 to accommodate the adaptor flange 20 in the release position.

In some embodiments, a flange biasing mechanism 26 may be provided on the adaptor body 2 and engage the adaptor flange 20. The flange biasing mechanism 26 may be any type of biasing device or mechanism which normally biases the adaptor flange 20 in the locking position on the adaptor body 2. For example and without limitation, in some embodiments, the flange biasing mechanism 26 may include a coiled flange bias spring 30. As illustrated in FIGS. 5, 5A and 5B, the flange bias spring 30 may be disposed in a spring cavity 28 which extends through the adaptor body 2 from the first adaptor body side surface 3 to the second adaptor body side surface 4 and protrudes beyond the adaptor body side surface 4 to engage the adaptor flange 20.

In some embodiments, the adaptor flange 20 may include an adaptor flange body 21 which is pivotally attached to the adaptor body 2 such as via the flange mount shaft 24. An adaptor flange tab 22 may protrude from the adaptor flange body 21 adjacent to the second attachment surface 8 of the adaptor body 2. A rail lock space 32 may be formed by and between the second attachment surface 8 of the adaptor body 2, the adaptor roller 16 and the adaptor flange body 21 and the adaptor flange 22 of the adaptor flange 20 for purposes which will be hereinafter described.

In typical application, the accessory rail adaptor 1 may facilitate expeditious attachment of the firearm support device 34 to the firearm 46 and detachment of the firearm support device 34 from the firearm 46. As illustrated in FIGS. 6 and 7, in some applications, the firearm 46 may be a standard or conventional automatic or semiautomatic rifle having a firearm receiver 47, a rear grip 48 and a stock 49 extending from the firearm receiver 47 and a barrel 52 extending forwardly from the firearm receiver 47. The upper accessory mount rail 54 and the lower accessory mount rail 55 may be provided on the barrel 52. The upper accessory mount rail 54 and the lower accessory mount rail 55 may each be a conventional Weaver rail mount or Picatinny mount (such as a mil-standard 1913 rail), for example and without limitation.

Figures 1, 2, 3, 4:
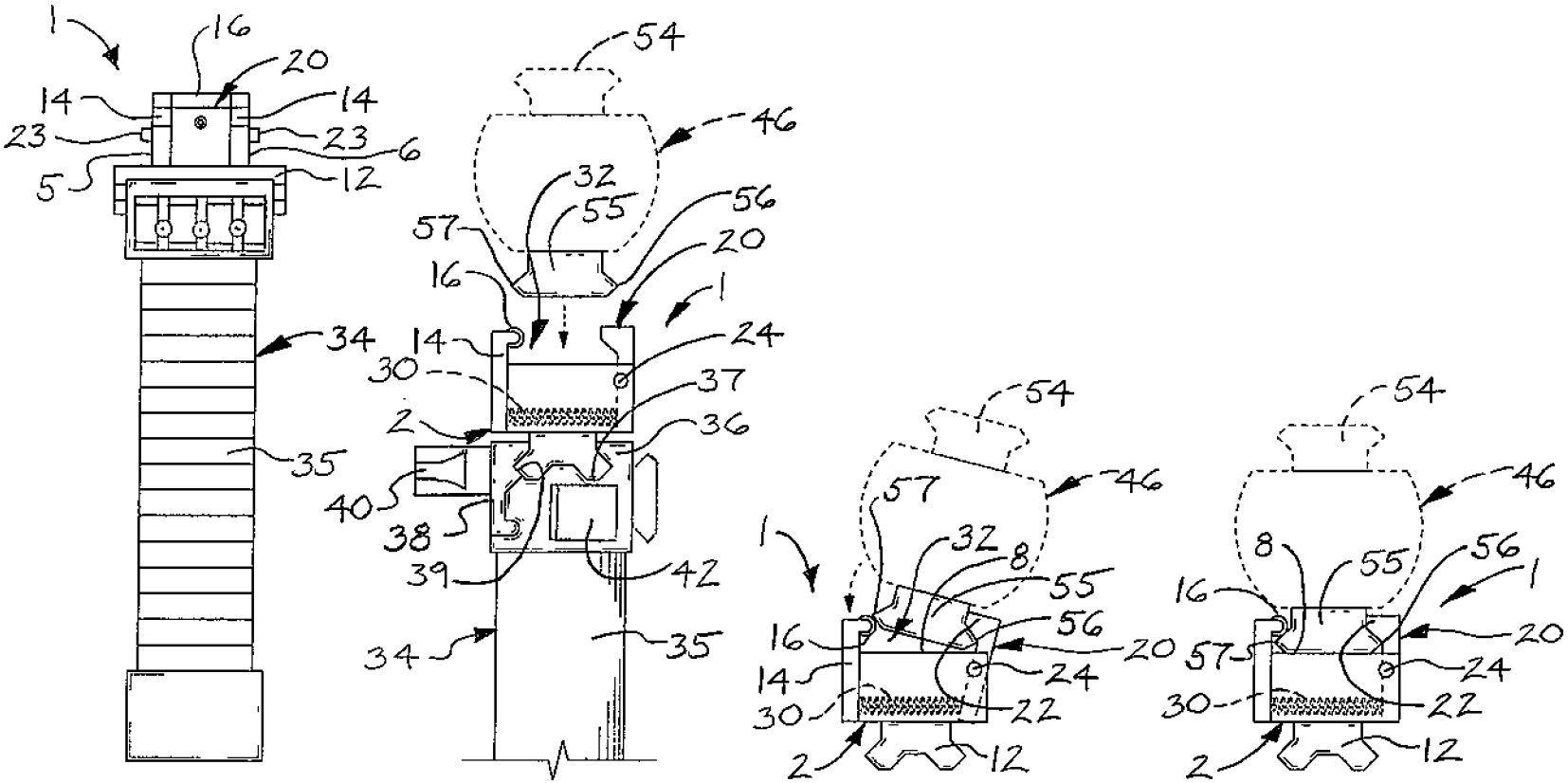
FIG. 1 is a side view of a firearm support device with an illustrative embodiment of the accessory rail adaptor attached to the firearm support device, preparatory to attachment of the accessory rail adaptor to a firearm.
FIG. 2 is an exploded front view with the illustrative accessory rail adaptor attached to the firearm support device, more particularly illustrating attachment of the firearm (illustrated partially in phantom) to the accessory rail adaptor.
FIG. 3 is a front view of the illustrative accessory rail adaptor, more particularly illustrating attachment of a lower accessory mount rail on the firearm to the accessory rail adaptor by initially inserting a first lateral rail edge of the lower accessory mount rail beneath an adaptor flange on the adaptor.
FIG. 4 is a front view of the illustrative accessory rail adaptor, more particularly illustrating completing attachment of the lower accessory mount rail on the firearm to the accessory rail adaptor by inserting a second lateral rail edge of the lower accessory mount rail beneath an adaptor roller on the adaptor.

As illustrated in FIG. 2, the firearm support device 34 may be standard or conventional with a device grip 35, a fixed rail receiving portion 36 having a fixed rail groove 37, an adjustable rail receiving portion 38 having an adjustable rail groove 39, a bipod rail slot 44 formed by the fixed rail groove 37 and the adjustable rail groove 39 and an adjusting knob 40 to facilitate selective positional adjustment of the adjustable rail receiving portion 38 relative to the fixed rail receiving portion 36 and vary the width of the bipod rail slot 44. A pair of bipod legs 41 (FIG. 7) may be selectively extendable from the device grip 35. A bipod leg deployment button 42 (FIG. 2) may facilitate spring-loaded deployment of the bipod legs 41 from the device grip 35 when depressed, typically in the conventional manner.

As illustrated in FIG. 4A, the accessory rail adaptor 1 may initially be attached to the firearm support device 34 by inserting the adaptor rail 12 on the accessory rail adaptor 1 into the fixed rail groove 37 and adjustable rail groove 39 of the bipod rail slot 44 in the firearm support device 34. The adjustable rail receiving portion 38 may be adjusted relative to the fixed rail receiving portion 36 to increase the width of the bipod rail slot 44 by loosening the adjusting knob 40. After the adaptor rail 12 is inserted in the bipod rail slot 44, the adjusting knob 44 may be tightened to secure the adjustable rail receiving portion 38 against the adaptor rail 12 typically in the conventional manner.

As illustrated in FIGS. 2-4, the accessory rail adaptor 1 may be attached to the lower accessory mount rail 55 on the firearm 46 as follows. The adaptor flange 20 is initially pivoted from the locking position illustrated in FIG. 5A to the release position illustrated in FIGS. 3 and 5B against the bias imparted by the flange biasing mechanism 26. As illustrated in FIG. 3, as the lower accessory mount rail 55 is oriented at an angled position relative to the adaptor body 2, a first lateral rail edge 56 of the lower accessory mount rail 55 is then inserted between the second attachment surface 8 on the adaptor body 2 and the adaptor flange tab 22 on the adaptor flange 20. As illustrated in FIG. 4, a second lateral edge 57 of the lower accessory mount rail 55 is then pushed against the adaptor roller 16, which rotates between the roller mount arms 14 until the second lateral edge 57 snaps between the adaptor roller 16 and the second attachment surface 8 of the adaptor body 2 as the flange biasing mechanism 26 returns the adaptor flange 20 to the locking position illustrated in FIG. 4. Accordingly, the lower accessory mount rail 55 is securely seated in the rail lock space 32 against the second attachment surface 8 of the adaptor body 2. The firearm support device 34 may then serve as a grip for a user, as illustrated in FIG. 6, or as a support to support the firearm 46 on the ground or other support surface 60, as illustrated in FIG. 7, as the user fires the firearm 46. It will be appreciated by those skilled in the art that the accessory rail adaptor 1 securely mobilizes the lower accessory mount rail 55 on the firearm 46 by preventing forward and rearward recoil motion of the firearm 46 relative to the firearm support device 34 during shooting. The firearm support device 34 can be selectively detached from the firearm 46 by disengaging the second lateral rail edge 57 of the lower accessory mount rail 55 from the second attachment surface 8 of the adaptor body 2 while rotating the second lateral edge 57 against the adaptor roller 16 and then removing the first lateral rail edge 56 of the lower accessory rail mount 55 from the rail lock space 32.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. An accessory rail adaptor, comprising:

an adaptor body having a first attachment surface and a second attachment surface;

an adaptor rail carried by the first attachment surface of the adaptor body;

an adaptor roller carried by the adaptor body adjacent to the second attachment surface; and an adaptor flange carried by the adaptor body adjacent to the second attachment surface and in spaced-apart relationship to the adaptor roller, the adaptor flange selectively moveable relative to the adaptor roller.

2. The accessory rail adaptor of claim 1 wherein the adaptor flange is pivotally carried by the adaptor body.

3. The accessory rail adaptor of claim 2 further comprising a flange biasing mechanism carried by the adaptor body and engaging the adaptor flange.

4. The accessory rail adaptor of claim 3 wherein the flange biasing mechanism comprises a coiled flange bias spring.

5. The accessory rail adaptor of claim 4 further comprising a spring cavity extending through the adaptor body, and wherein the flange bias spring is disposed in the spring cavity.

6. The accessory rail adaptor of claim 1 further comprising a pair of spaced-apart roller mount arms carried by the adaptor body, and wherein the adaptor roller is carried by the roller mount arms.

7. The accessory rail adaptor of claim 1 wherein the adaptor flange comprises an adaptor flange body pivotally carried by the adaptor body and an adaptor flange tab carried by the adaptor flange body, the adaptor flange tab protruding adjacent to the second attachment surface of the adaptor body.

8. The accessory rail adaptor of claim 1 further comprising a plurality of adaptor ridges on the second attachment surface of the adaptor body.

9. An accessory rail adaptor, comprising:

an adaptor body having a first attachment surface, a second attachment surface opposite the first attachment surface, a first adaptor body side surface and a second adaptor body side surface opposite the first adaptor body side surface;

an adaptor rail carried by the first attachment surface of the adaptor body;

an adaptor roller carried by the first adaptor body side surface of the adaptor body and disposed adjacent to the second attachment surface;

an adaptor flange carried by the second adaptor body side surface of the adaptor body and disposed adjacent to the second attachment surface and in spaced-apart relationship to the adaptor roller, the adaptor flange selectively moveable between a locking position oriented toward the adaptor roller and a release position oriented away from the adaptor roller; and a rail lock space formed by and between the second attachment surface of the adaptor body, the adaptor roller and the adaptor flange.

10. The accessory rail adaptor of claim 9 wherein the adaptor flange is pivotally carried by the adaptor body.

11. The accessory rail adaptor of claim 10 further comprising a flange biasing mechanism carried by the adaptor body and engaging the adaptor flange.

12. The accessory rail adaptor of claim 11 wherein the flange biasing mechanism comprises a coiled flange bias spring.

13. The accessory rail adaptor of claim 12 further comprising a spring cavity extending through the adaptor body between the first adaptor body side surface and the second adaptor body side surface, and wherein the flange bias spring is disposed in the spring cavity.

14. The accessory rail adaptor of claim 9 further comprising a pair of spaced-apart roller mount arms carried by the first adaptor body side surface of the adaptor body, and wherein the adaptor roller is carried by the roller mount arms.

15. The accessory rail adaptor of claim 9 wherein the adaptor flange comprises an adaptor flange body pivotally carried by the second adaptor body side surface of the adaptor body and an adaptor flange tab carried by the adaptor flange body, the adaptor flange tab protruding adjacent to the second attachment surface of the adaptor body.

16. The accessory rail adaptor of claim 9 further comprising a plurality of adaptor ridges on the second attachment surface of the adaptor body.

17. An accessory rail adaptor, comprising:

an adaptor body having a first attachment surface, a second attachment surface opposite the first attachment surface, a first adaptor body side surface and a second adaptor body side surface opposite the first adaptor body side surface;

an adaptor rail carried by the first attachment surface of the adaptor body;

a pair of spaced-apart roller mount arms carried by the first adaptor body side surface of the adaptor body;

an adaptor roller carried by the roller mount arms, the adaptor roller disposed adjacent to the second attachment surface;

an adaptor flange including an adaptor flange body pivotally carried by the second adaptor body side surface of the adaptor body and an adaptor flange tab protruding from the adaptor flange body and disposed adjacent to the second attachment surface and in spaced-apart relationship to the adaptor roller, the adaptor flange selectively pivotal between a locking position with the flange tab oriented toward the adaptor roller and an unlocking position with the flange tab oriented away from the adaptor roller;

a flange biasing mechanism carried by the adaptor body and engaging the adaptor flange body of the adaptor flange, the flange biasing mechanism normally biasing the adaptor flange in the locking position; and a rail lock space formed by and between the second attachment surface of the adaptor body, the adaptor roller and the adaptor flange.

18. The accessory rail adaptor of claim 17 wherein the flange biasing mechanism comprises a coiled flange bias spring.

19. The accessory rail adaptor of claim 18 further comprising a spring cavity extending through the adaptor body between the first adaptor body side surface and the second adaptor body side surface, and wherein the flange bias spring is disposed in the spring cavity.

20. The accessory rail adaptor of claim 17 further comprising a plurality of adaptor ridges on the second attachment surface of the adaptor body.

* * * * *